US005761791A

United States Patent [19]

Bando

[11] Patent Number: 5,761,791

[45] Date of Patent: Jun. 9, 1998

[54] METHOD OF MANUFACTURING A CHIP TRANSFORMER

[75] Inventor: Masahiro Bando, Nagaokakyo, Japan

[73] Assignee: Murata Manufacturing Co., Ltd., Japan

[21] Appl. No.: 528,395

[22] Filed: Sep. 14, 1995

Related U.S. Application Data

[62] Division of Ser. No. 359,609, Dec. 20, 1994, abandoned.

[30] Foreign Application Priority Data

Dec. 24, 1993 [JP] Japan ..... 5-347460

[51] Int. Cl.[6] ..... H01F 41/06

[52] U.S. Cl. ..... 29/609; 29/602.1; 336/200

[58] Field of Search ..... 29/602.1, 609; 336/192, 200, 232

[56] References Cited

U.S. PATENT DOCUMENTS 3,765,082 10/1973 Zyetz ..... 29/602.1

5,197,170 3/1993 Senda et al. ..... 29/602.1 X

FOREIGN PATENT DOCUMENTS 404354309A 12/1992 Japan ..... 336/192

*Primary Examiner*—Carl E. Hall

*Attorney, Agent, or Firm*—Ostrolenk, Faber, Gerb & Soffen, LLP

[57] ABSTRACT

A body 12 of a chip-type transformer includes two magnetic plates 14, 30 and insulating sheets 16, 20, 24, and 28. Ring-shaped patterned electrodes 18, 22 and 26 are formed on the insulating sheets 16, 20 and 24. The ends 18*a* and 18*b* of the patterned electrode 18 and the ends 26*a* and 26*b* of the patterned electrode 26 are led out to the same side of the insulating sheets 16 and 24. The ends 22*a* and 22*b* of the patterned electrode 22 are led out to the opposite side of the insulating sheets. The magnetic plates 14, 30 and the insulating sheets 16, 20, 24 and 28 are laminated, and external electrodes connected to the patterned electrodes are formed. The ends 18*b* and 26*a* of the patterned electrodes are connected by the external electrodes.

14 Claims, 9 Drawing Sheets

METHOD OF MANUFACTURING A CHIP TRANSFORMER

This is a division of application Ser. No. 08/359,609, filed Dec. 20, 1994, now abandoned.

BACKGROUND OF THE INVENTION

1. Field of the Invention

The present invention relates to a chip-type transformer, particularly to chip-type transformer or use as, for example, a 180-degree phase distributor, balun transformer, inverter, etc. and its manufacturing method.

2. Description of the Prior Art

FIG. 6 is an illustrative view showing a 180-degree phase distributor as an example of a transformer made by the conventional technology. The 180-degree phase distributor 1 is made by winding the three coils 3*a*, 3*b*, 3*c* around the toroidal core. The coils 3*a*, 3*b*, 3*c* are wound together in a bunch. There is a 180-degree phase distributor wherein the three coils 3*a*, 3*b*, 3*c* are wound around a figure-eight-shaped core 4 as shown in FIG. 7. In these conventional 180-degree phase distributors, when the ends of the coils 3*a*, 3*b*, 3*c* are defined as A, B, C and their other ends of are defined as A', B', C', the end B' of the coil 3*b* and the end C of the coil 3*c* are connected to each other as shown in FIG. 8.

When a signal is supplied to the coil 3*a* of the 180-degree phase distributor, the output signals are obtained from between the end B of the coil 3*b* and the connecting point of the coils 3*b* and 3*c* and from between the end C' of the coil 3*c* and the connecting point of the coils 3*b* and 3*c*. The two output signals are at about the same voltage level as the input signal to the coil 3*a*, and different in phase by 180 degrees from each other.

However, unless the three coils are wound evenly in the conventional transformer, variation in inductance is produced at high frequencies and balanced output signals can not be obtained. At a high frequency such as UHF or higher, when the wavelength is indicated with $\lambda$, the line length of the coil must be less than $\lambda/4$. When a signal having a frequency of 10 GHz is used, the line length of the coil is about 7.2 mm. However, in an transformer in which the coils are wound around the core, the line length cannot be shortened due to the dimensional restrictions.

Though the toroidal core or figure-eight-shaped core is used in the conventional transformer, these cores are the obstacle to miniaturization. When the transformer is mounted on the printed circuit board by an automatic machine, it must be fixed on a plastic base or the like. When such base is used, the transformer becomes large, and resulting in disadvantage for miniaturization. In the conventional transformer, the manufacturing is complicated because the core must be wound and the transformer must be attached to the base, and resulting in high manufacturing cost.

SUMMARY OF THE INVENTION

The primary object of the present invention is to provide a chip-type transformer which has less variation of characteristics at high frequencies, small size, low manufacturing cost, and can be mounted on a printed circuit board by the automatic machines. Another object of the present invention is to provide a manufacturing method of the chip-type transformer.

The present invention is directed to a chip-type transformer comprising plural insulating sheets, ring-shaped patterned electrodes formed on each of the insulating sheets, and two magnetic plates for sandwiching the plural insulating sheets, wherein the insulating sheets and the magnetic plates are laminated so that the plural patterned electrodes are piled up with the insulating sheets therebetween.

The present invention is directed to a manufacturing method of a transformer comprising the following steps: (a) preparing a first magnetic plate, (b) forming an insulating sheet on the first magnetic plate, (c) forming plural ring-shaped patterned electrodes on the insulating sheet, (d) forming an another insulating sheet on the patterned electrodes, and further forming additional ring-shaped patterned electrodes on the other insulating sheet so that the additional patterned electrodes are positioned geometrically just above the patterned electrodes, (e) laminating still another insulating sheet and a second magnetic plate on the additional patterned electrodes to make a laminate body, (f) cutting the laminate body, and (g) forming external electrodes connected to the patterned electrodes and the additional patterned electrodes on the external faces of each of the cut laminate bodies.

In the manufacturing method of a transformer, the step (d) may be repeated a plurality of times according to the necessity.

Plural ring-shaped patterned electrodes are piled up by laminating the insulating sheets on which the patterned electrodes are formed. In this arrangement, when a signal is supplied to one ring-shaped patterned electrode, the produced magnetic flux is interlinked to the other patterned electrode. The chip-type transformer is made by laminating the insulating sheets and the magnetic plates.

According to the present invention, since the ring-shaped patterned electrodes are formed on the insulating sheets, the patterned electrodes can be formed in a correct shape. Therefore, little variation in inductance and a wellbalanced output signal can be obtained. Since the patterned electrodes are formed on the insulating sheets their, line length can be adjusted desirably to obtain a chip-type transformer that can be used at high frequencies. Since the core and coils which are the individual parts of the conventional transformer are not necessary, the transformer can be miniaturized. Moreover, since the insulating sheets and magnetic plates are laminated, the chip-type transformer can be produced more easily at a low cost as compared with the conventional transformer in which the core and coils are used. Since the transformer is a chip-type, automatic mounting of the chip-type transformer is possible.

The above and further objects, features, aspects and advantages of the present invention will be more fully apparent from the following detailed description with the accompanying drawings.

DESCRIPTION OF THE PREFERRED EMBODIMENTS

Figure 1:
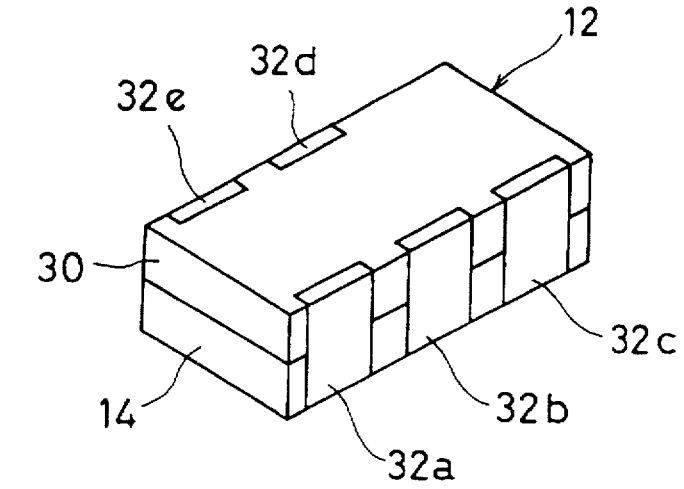
FIG. 1 is a perspective view showing an embodiment of the present invention.
Figure 2:
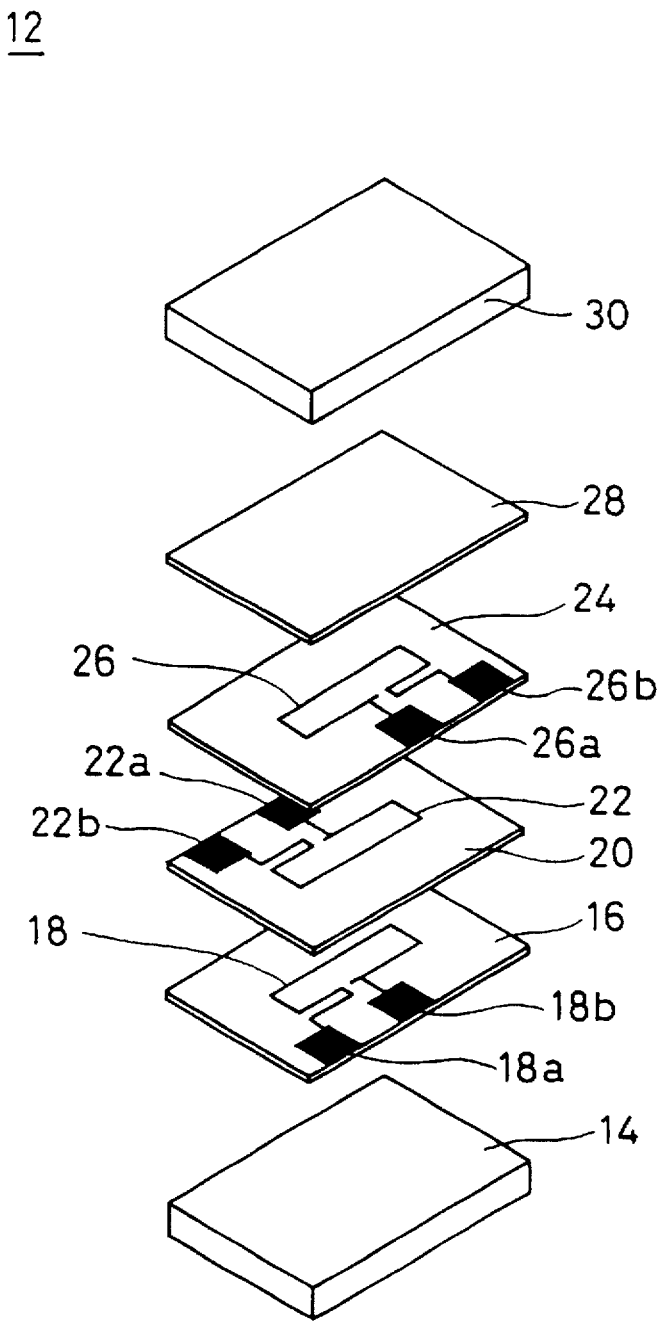
FIG. 2 is an exploded perspective view showing a body of the chip-type transformer shown in FIG. 1.
Figure 3:
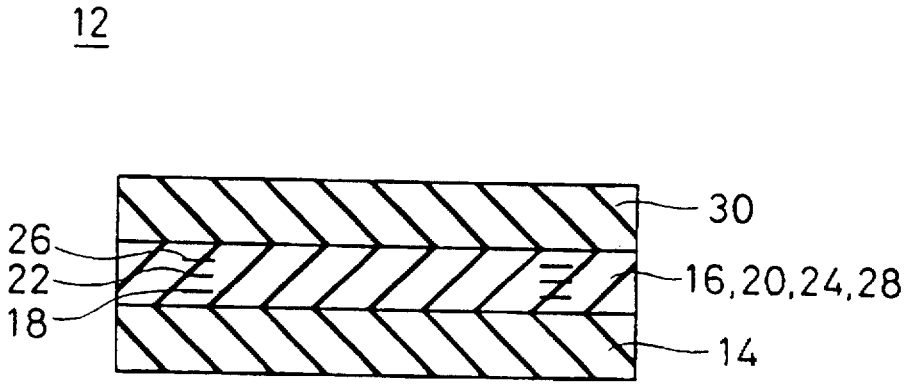
FIG. 3 is a sectional view of the body shown in FIG. 2.

FIG. 1 is a perspective view showing an embodiment of the present invention. A chip-type transformer 10 includes a body 12. The body 12 has a first magnetic plate 14 as shown in FIG. 2. As the first magnetic plate 14, an alumina plate or a ferrite plate is used. A first insulating sheet 16 is laminated on the first magnetic plate 14. A first patterned electrode 18 is formed on the first insulating sheet 16. The first patterned electrode 18 is formed in a ring-shape and the ends 18*a* and 18*b* are led out to an end of the first insulating sheet 16. The words "magnetic plate" and "insulating sheet" used above in relation to the present invention imply some functional meanings and do not characterize their strength and hardness. This applies to the following descriptions.

A second insulating sheet 20 is laminated on the first patterned electrode 18. A second patterned electrode 22 is formed on the second insulating sheet 20. The second patterned electrode 22 is formed in a ring-shape and the ends 22*a* and 22*b* are led out to an end of the second insulating sheet 20. The both ends 22*a* and 22*b* of the second patterned electrode 22 are led out to the opposite end to the end to which the both ends 18*a* and 18*b* of the first patterned electrode 18 are led out. The ring-shape portion of the second patterned electrode 22 is formed so that it is positioned geometrically just above that of the first patterned electrode 18.

A third insulating sheet 24 is laminated on the second patterned electrode 22. A third patterned electrode 26 is formed on the third insulating sheet 24. The third patterned electrode 26 is formed in a ring-shape and the ends 26*a* and 26*b* are led out to an end of the third insulating sheet 24. The both ends 26*a* and 26*b* of the third patterned electrode 26 are led out to the same side end to which the both ends 18*a* and 18*b* of the first patterned electrode 18 are led out. At this time, the end 26*a* of the third patterned electrode 26 is arranged so that it is positioned geometrically just above the end 18*b* of the first patterned electrode 18. The ring-shape portion of the third patterned electrode 26 is formed so that it is positioned geometrically just above the ring-shape portions of the first patterned electrode 18 and the second patterned electrode 22.

A fourth insulating sheet 28 is laminated on the third patterned electrode 26. The first insulating sheet 16, the second insulating sheet 20, the third insulating sheet 24, and the fourth insulating sheet 28 are made of polyimide resin or the like. A second magnetic plate 30 is laminated on the fourth insulating sheet 28. As the second magnetic plate 30, for example, an alumina plate or ferrite plate is used. The first magnetic plate 14, the first insulating sheet 16, the second insulating sheet 20, the third insulating sheet 24, the fourth insulating sheet 28, and the second magnetic plate 30 are laminated and integrated, and the body 12 is formed. Consequently, when looking at the interior of the body 12, the ring-shape portions of the three patterned electrodes 18, 22 and 26 are overlapped with insulating sheets therebetween. In this case, the magnetic plates and insulating sheets are laminated and integrated by bonding or welding, and the method is not restricted.

External electrodes 32*a*, 32*b*, 32*c*, 32*d*, and 32*e* are formed on the side faces of the body 12. The external electrode 32*a* is connected to the end 18*a* of the first patterned electrode 18. The external electrode 32*b* is connected to the end 18*b* of the first patterned electrode 18 and the end 26*a* of the third patterned electrode 26. Thus, the first patterned electrode 18 and the third patterned electrode 26 are connected by the external electrode 32*b*. The insulating sheets 20 and 24 which are placed on the end 18*b* of the first patterned electrode 18 may be cut off so that the end 18*b* of the first patterned electrode 18 and the end 26*a* of the third patterned electrode 26 are overlapped and connected with each other. The external electrode 32*c* is connected to the end 26*b* of the third patterned electrode 26. The external electrode 32*d* is connected to the end 22*a* of the second patterned electrode 22. The external electrode 32*e* is connected to the end 22*b* of the second patterned electrode 22.

Figure 5A:
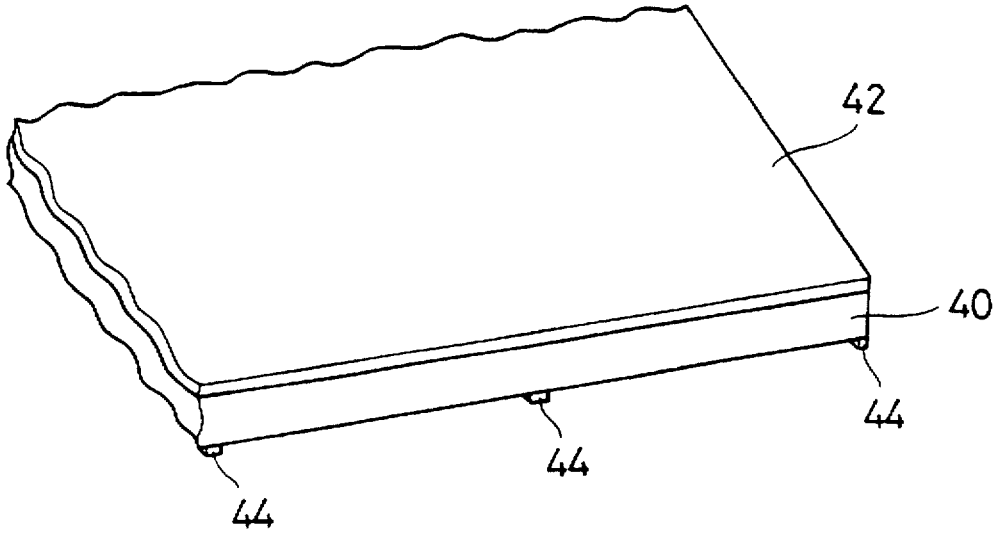
FIGS. 5(A)-5(G) are illustrative views showing a manufacturing method of the chip-type transformer shown in FIG. 1.

When manufacturing the chip-type transformer 10, a ferrite plate 40 which makes the magnetic plate 14 is prepared as shown in FIG. 5(A). One face of the ferrite plate 40 is coated with polyimide resin 42. The other face of the ferrite plate 40 is coated with polyimide resin 44 with certain intervals. The polyimide resin 42 and 44 are exposed to light, developed, and heat-processed in vacuum to make the first insulating sheet 16 and the marking portions 46. In this embodiment, plural patterned electrodes are formed on the ferrite plate 40 and then plural chip-type transformers can be produced by cutting them apart. The marking portions 46 are the marks for cutting, and positioned at the four corners of each chip-type transformer.

Figure 5B:
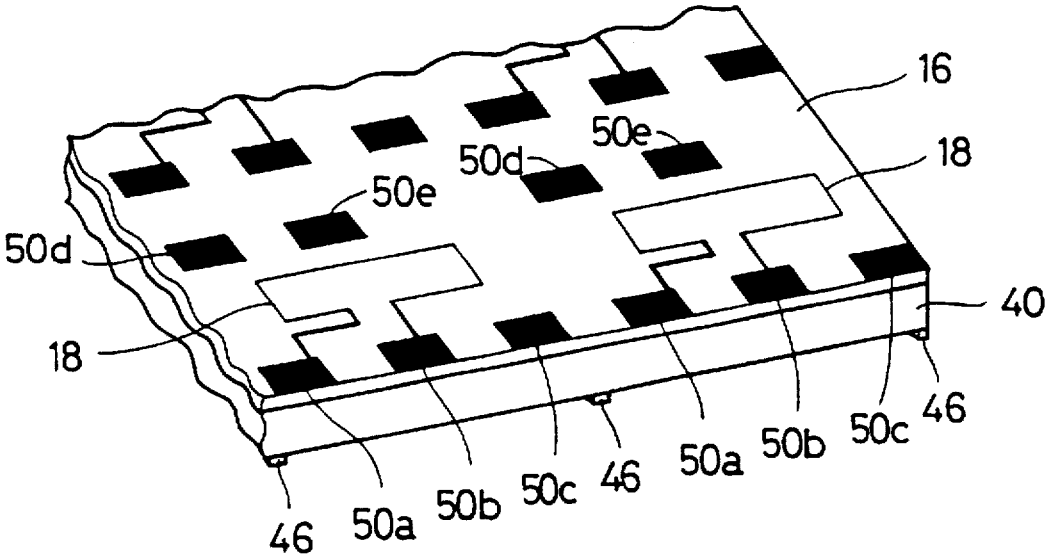

Plural first patterned electrodes 18 are formed on the first insulating sheet 16 by photolithograph. At this time, an electrode layer is formed on the first insulating sheet 16 by sputtering. Then, photo-resist is applied on the electrode layer. The photomask for forming the first patterned electrodes 18 is placed on the photo-resist and then it is exposed to light and developed. In the next step, unnecessary electrode layer is removed by etching. Then, the residual photoresist is peeled off and the first patterned electrodes 18 are made as shown in FIG. 5(B). Here, electrodes 50*a*, 50*b*, 50*c*, 50*d*, and 50*e* are formed at the portions corresponding to the ends 18*a*, 18*b*, 22*a*, 22*b*, 26*a* and 26*b* of the patterned electrodes 18, 22 and 26.

Figure 5C:
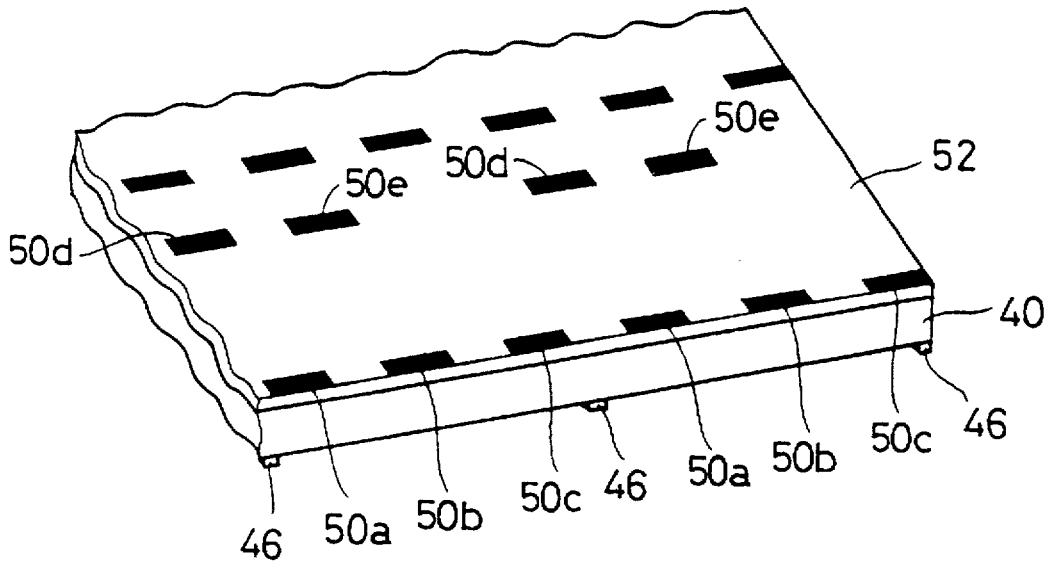

A polyimide resin 52 which makes the second insulating sheet 20 is applied on the first patterned electrodes 18 as shown in FIG. 5(C). At this time, the polyimide resin 52 is applied so that a part of electrodes 50*a*–50*e* is exposed. The second insulating sheet 20 is formed in the same way as for the first insulating sheet 16.

Figure 5D:
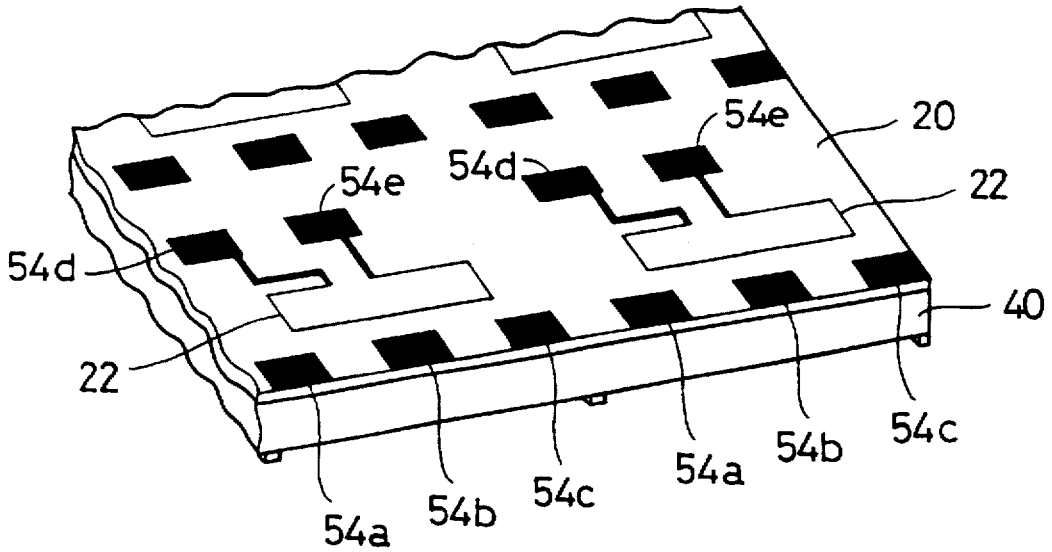

Further, the second patterned electrodes 22 are formed on the second insulating sheet 20 in the same way as for the first patterned electrodes 18 as shown in FIG. 5(D). At this time, the electrodes 54*a*–54*e* are formed so that they are positioned geometrically just above the electrodes 50*a*–50*e* and each pair of electrodes arranged above and below are connected electrically.

Figure 5E:
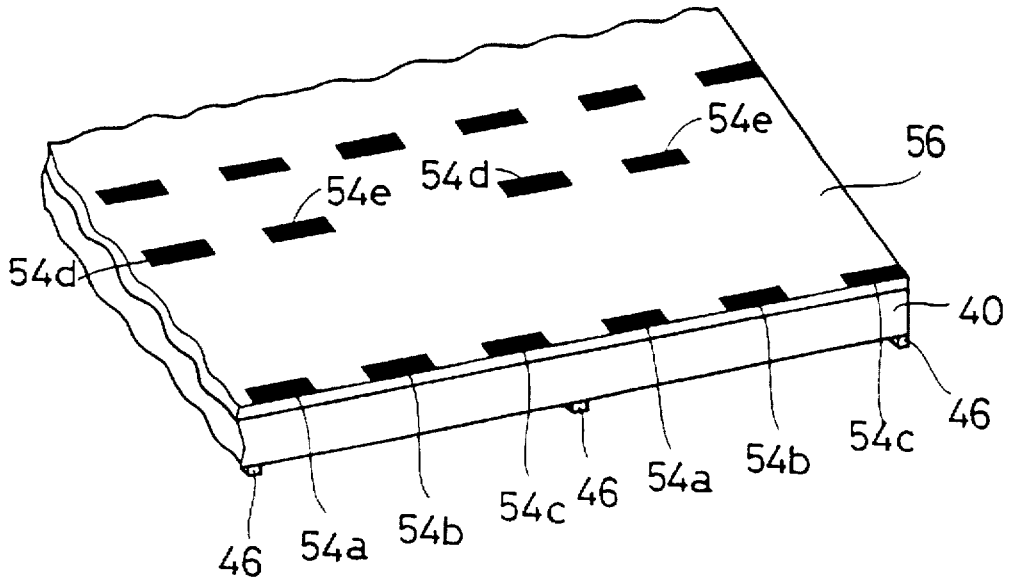

A polyimide resin 56 is applied on the second patterned electrodes 22 so that a part of the electrodes 54*a*–54*e* is exposed as shown in FIG. 5(E). Then, the third insulating sheet 24 is formed in the same way as for the first insulating sheet 16 and the second insulating sheet 20.

Figure 5F:
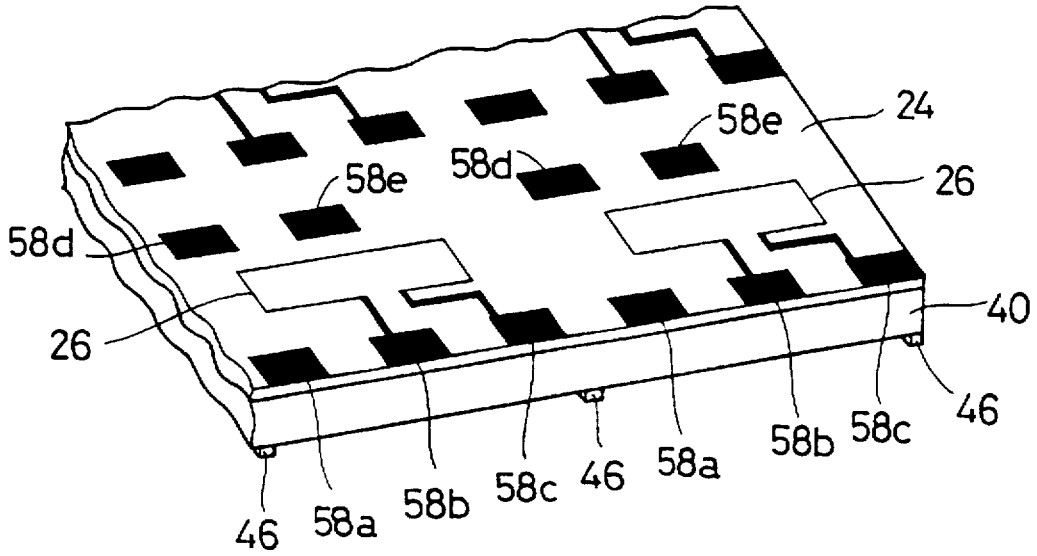

Furthermore, the third patterned electrodes 26 are formed on the third insulating sheet 24 in the same way as for the first patterned electrodes 18 and the second patterned electrodes 22 as shown in FIG. 5(F). At this time, the electrodes 58*a*–58*e* are formed so that they are positioned geometrically just above the electrodes 54*a*–54*e* and each pair of electrodes arranged above and below are connected electrically.

Figure 5G:
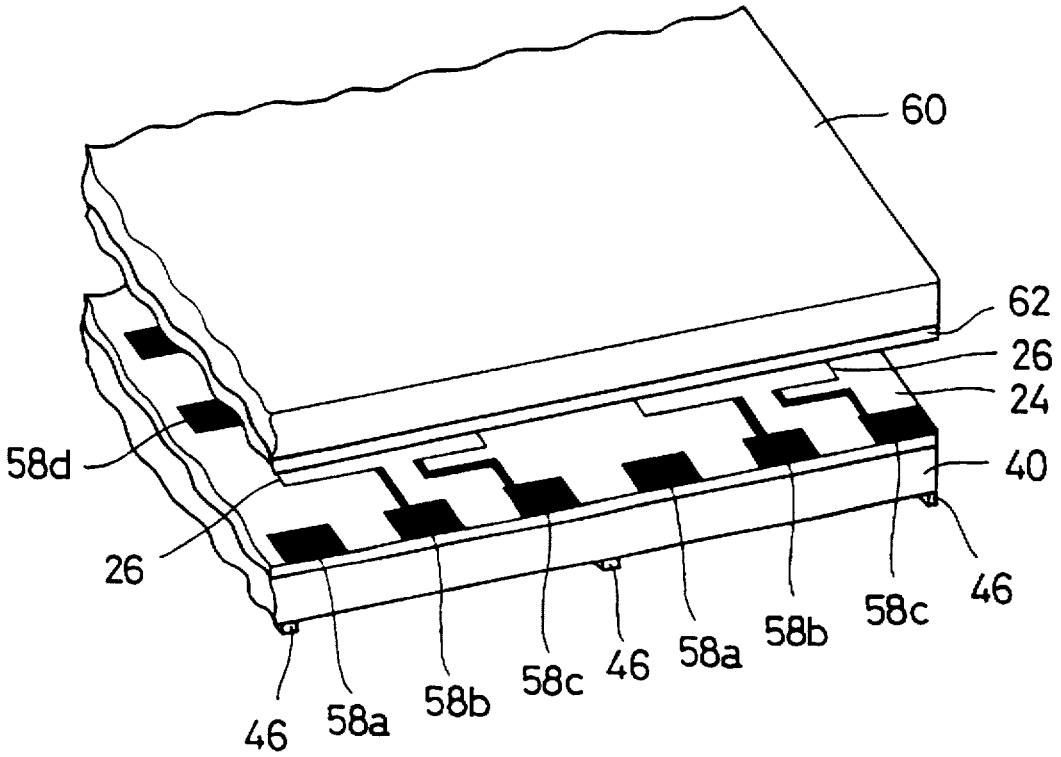
Figure 6:
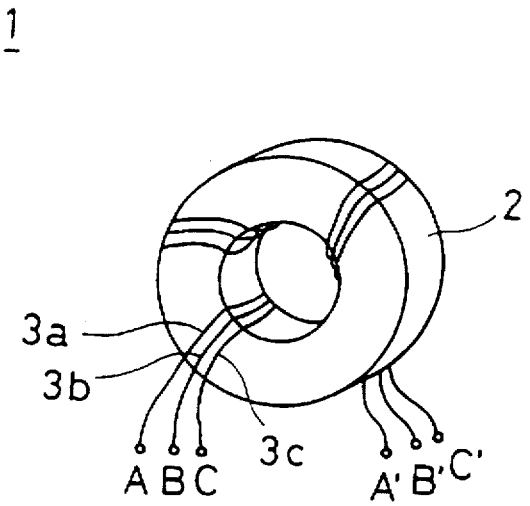
FIG.6 PRIOR ART
FIG. 6 is an illustrative view showing a transformer made by the conventional technology.
Figure 7:
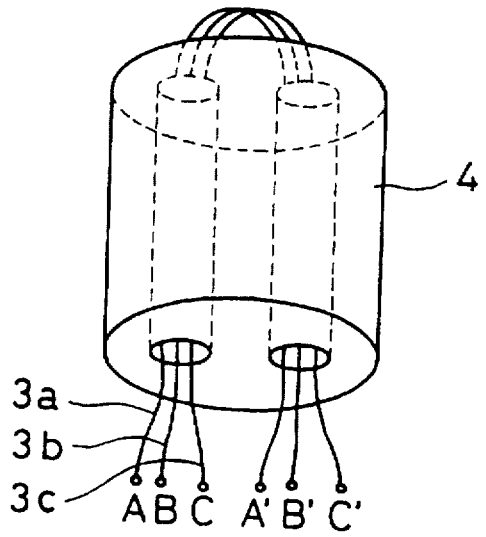
FIG.7 PRIOR ART
FIG. 7 is an illustrative view showing an another transformer made by the conventional technology.
Figure 8:
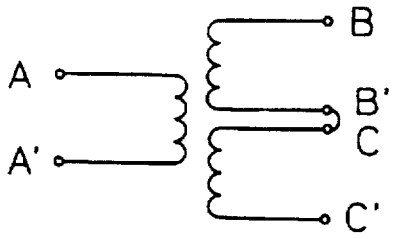
FIG.8 PRIOR ART
FIG. 8 is an illustrative view showing a connection of the conventional transformers shown in FIGS. 6 and 7.

In the next stage, a polyimide resin 62 for bonding is applied on one entire face of an another ferrite plate 60. Then, the ferrite plate 60 is laminated so that the polyimide resin 62 is placed on the third patterned electrodes 26 as shown in FIG. 5(G). The laminated body is hot-pressed in vacuum and the ferrite plate 60 is bonded. At this time, the polyimide resin 62 applied on the ferrite plate 60 makes the fourth insulating sheet 28.

The laminated body thus produced is cut according to the marking portions 46. The laminated bodies just cut are barrel-polished and the external electrodes 32*a*–32*e* are formed on them by sputtering. These external electrodes 32*a*–32*e* are connected electrically to the internally formed electrodes 50*a*–50*e*, 54*a*–54*e* and 58*a*–58*e*. In this way, the chip-type transformer 10 shown in FIG. 1 is manufactured.

Figure 4:
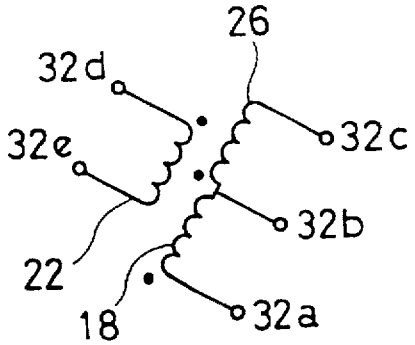
FIG. 4 is an equivalent circuit diagram of the chip-type transformer shown in FIG. 1.

In the chip-type transformer 10, the second patterned electrode 22 is used for inputting a signal, and the first patterned electrode 18 and the third patterned electrode 26 are used for outputting a signal. Thus, the chip-type transformer 10 has an equivalent circuit as shown in FIG. 4. As can be seen from FIG. 4, when a signal is supplied between the external electrodes 32*d* and 32*e*, a magnetic flux is generated by the second patterned electrode 22. The magnetic flux is interlinked to the first patterned electrode 18 and the third patterned electrode 26 to obtain output signals from between the external electrodes 32*a* and 32*b* and from between the external electrodes 32*b* and 32*c*. The levels of these output signals are almost the same as that of the input signal to the second patterned electrode 22. Moreover, these two output signals are in reverse phases to each other. Consequently, the chip-type transformer 10 can be used as the 180-degree phase distributor.

In the chip-type transformer 10, since the patterned electrodes are formed on the insulating sheets, the shape and length of the patterned electrode can be adjusted without restrictions. Consequently, the three patterned electrodes 18, 22, 26 can be designed to have almost the same inductance. Furthermore, in the chip-type transformer 10 having the above structure, the coupling coefficient between the second patterned electrode 22 and the first patterned electrode 18 is almost equal to that between the second patterned electrode 22 and third patterned electrode 26.This results in a good balance between the two output signals. By using the thin film method as the above embodiment, the distance between patterned electrodes can be shortened to several microns as well as obtaining an inductance with high accuracy, and the transformer having very large coupling coefficient can be obtained.

Since the line lengths of the patterned electrodes 18, 22, and 26 can be adjusted without restriction, a chip-type transformer that can be used in high frequencies can be obtained by shortening the line length to obtain a small inductance. When the ring-shaped pattern is meandered, the pattern area can be made smaller without changing the line length, thus the chip-type transformer can be miniaturized. Further, since the chip-type transformer 10 is manufactured by laminating the magnetic plates 14 and 30 and the insulating plates 16, 20, 24, and 28, the transformer can be a chip part. Consequently, the transformer 10 can be surface-mounted on the printed circuit board by a automatic machine. Moreover, the chip-type transformer 10 can be manufactured easily as compared with the conventional transformer having coils around the core, and resulting in low manufacturing cost.

By using the output signal from between the external electrodes 32*a* and 32*c* of the chip-type transformer 10, a balanced signal can be obtained. This means that the chip-type transformer 10 can be used as a balun transformer whose input signal is an imbalanced signal but the output signal is a balanced signal. Further, when two patterned electrodes are formed in the body 12, the chip-type transformer 10 can be used as an inverter. In this case, an imbalanced signal is supplied to one patterned electrode and an imbalanced signal whose phase is inverted by 180 degrees can be obtained from the other patterned electrode.

Insulating ceramics can be used as the insulating sheet material. Though the dielectric ceramics and magnetic ceramics exist as the insulating ceramics, when using the magnetic ceramics, a substance with low permeability is desirable. The reason is that, if permeability is large, a magnetic flux generated in the patterned electrode concentrates around it and may not be interlinked to the other patterned electrodes. When using the ceramics as the insulating sheet, it can be integrated with the magnetic plates by co-firing to make a laminated body.

The number of patterned electrodes may not be limited to three, but two patterned electrodes or four or more patterned electrodes may be laminated. The number of repetition times for the forming processes of the insulating sheets and patterned electrodes can be adjusted to produce these chip-type transformers.

While the present invention has been particularly described and shown, it is to be understood that such description is used merely as an illustration and example rather than limitation, and the spirit and scope of the present invention is determined solely by the terms of the appended claims.

What is claimed is:

1. A method of manufacturing a chip transformer comprising the following steps:

(a) preparing a first magnetic plate;

(b) forming an insulating sheet on said first magnetic plate;

(c) forming a first plurality of ring-shaped patterned electrodes on said insulating sheet;

(d) forming a second insulating sheet on said patterned electrodes, and further forming a second plurality of ring-shaped patterned electrodes on said second insulating sheet so that said second plurality of patterned electrodes are positioned above said first plurality of patterned electrodes;

wherein said first and second insulating sheets are formed by exposing and developing light-curable polyimide resin;

wherein said first and second pluralities of ring-shaped patterned electrodes are formed with approximately equal line lengths, and with respective ones of said first and second pluralities overlapping each other with said second insulating sheet therebetween;

(e) laminating a third insulating sheet and a second magnetic plate on said second plurality of patterned electrodes to make a laminate body;

(f) cutting said laminate body to form a plurality of cut laminate bodies;

(g) forming external electrodes connected to said first plurality and said second plurality of patterned electrodes on the external faces of each of said cut laminate bodies.

2. A method of manufacturing a chip transformer in accordance with claim 1, which further comprises the step (h) of repeating said step (d) at least one additional time after said step (d).

3. A method of manufacturing a chip transformer in accordance with claim 1, wherein said first and second pluralities of patterned electrodes are formed by photolithography.

4. A method of manufacturing a chip transformer in accordance with claim 1, wherein marks are formed on said first magnetic plate for guiding the cutting of said laminated body in said step (f).

5. A method of manufacturing a chip transformer in accordance with claim 2, wherein said first and second pluralities of patterned electrodes are formed by photolithography.

6. A method of manufacturing a chip transformer in accordance with claim 1, wherein said third insulating sheet is made of an adhesive resin and adheres said second magnetic plate onto said second plurality of patterned electrodes.

7. A method of manufacturing a chip transformer in accordance with claim 2, wherein said third insulating sheet is made of an adhesive resin and adheres said second magnetic plate onto said second plurality of patterned electrodes.

8. A method of manufacturing a chip transformer in accordance with claim 3, wherein said third insulating sheet is made of an adhesive resin and adheres said second magnetic plate onto said second plurality of patterned electrodes.

9. A method of manufacturing a chip transformer in accordance with claim 5, wherein said third insulating sheet is made of an adhesive resin and adheres said second magnetic plate onto said second plurality of patterned electrodes.

10. A method of manufacturing a chip transformer in accordance with claim 1, wherein said first and second magnetic plates are fired prior to said preparing and laminating steps (a) and (e).

11. A method of manufacturing a chip transformer in accordance with claim 2, wherein said first and second magnetic plates are fired prior to said preparing and laminating steps (a) and (e).

12. A method of manufacturing a chip transformer in accordance with claim 3, wherein said first and second magnetic plates are fired prior to said preparing and laminating steps (a) and (e).

13. A method of manufacturing a chip transformer in accordance with claim 5, wherein said first and second magnetic plates are fired prior to said preparing and laminating steps (a) and (e).

14. A method of manufacturing a chip transformer in accordance with claim 6, wherein said first and second magnetic plates are fired prior to said preparing and laminating steps (a) and (e).

* * * * *